United States Patent [19]

Yokoyama

[11] 3,946,666

[45] Mar. 30, 1976

[54] COMMA PRINTING MECHANISM

[75] Inventor: Shizuo Yokoyama, Tokyo, Japan

[73] Assignee: Ricoh Co., Ltd., Tokyo, Japan

[22] Filed: Oct. 21, 1974

[21] Appl. No.: 516,664

[30] Foreign Application Priority Data

Oct. 25, 1973 Japan ..... 48-123215[U]
May 16, 1974 Japan ..... 49-53831

[52] U.S. Cl. ..... 101/99; 101/110
[51] Int. Cl.[2] ..... B41J 1/32
[58] Field of Search .....101/95, 96, 99, 110 93.37–93.46; 235/60.15

[56] References Cited

UNITED STATES PATENTS

| | | | |
|---|---|---|---|
| 2,872,862 | 2/1959 | Lydfors | 101/93.37 |
| 3,016,007 | 1/1962 | Gelling | 101/93.45 |
| 3,138,325 | 6/1964 | Stephen | 235/60.15 |
| 3,422,754 | 1/1969 | Bakardjiev et al. | 101/99 X |
| 3,690,249 | 9/1972 | Nihira | 101/95 |
| 3,738,264 | 6/1973 | Sobottka et al. | 101/110 |
| 3,861,302 | 1/1975 | Mizvtani et al. | 101/99 |

*Primary Examiner*—Edgar S. Burr
*Assistant Examiner*—Edward M. Coven
*Attorney, Agent, or Firm*—Cooper, Dunham, Clark, Griffin & Moran

[57] ABSTRACT

A printing apparatus in which a comma printing mechanism prints commas at any desired location within a printed number. Comma printing is accomplished by comma hammers, with one hammer provided between each two numerical places of the printing apparatus. All the comma hammers are initially maintained in a nonprinting position, and all are moved to an intermediate position prior to the printing of a number. Selected comma hammers, corresponding to the locations within a number at which comma printing is desired, are then advanced to a printing position, and the number is printed. After the number and selected commas are printed, the comma hammers are returned to the initial nonprinting position.

4 Claims, 10 Drawing Figures

COMMA PRINTING MECHANISM

BACKGROUND OF THE INVENTION

This invention relates to a printing apparatus, and more particularly to a comma printing mechanism for a printer adapted for use with a table electronic calculator or the like.

Printers of one type known in the art comprise a plurality of type wheels, a plurality of selectors each adapted to cause one of the type wheels to stop in a desired position, a plurality of trigger claws each adapted to normally maintain one of the selectors in an inoperative position and to release the same from its inoperative position to cause the selector to interrupt the movement of the associated type wheel, a plurality of electromagnets each provided with an actuator for controlling the operation of one of the trigger claws, and a platen adapted to move relative to the type wheels during the printing process.

Many printers of the aforementioned type are not provided with a comma printing mechanism. Printers employing a comma printing mechanism typically use one of two known methods. In one type of prior art comma printing mechanism a fixed decimal point is inserted, and commas or spaces between the digits are then located at positions determined by the fixed decimal point. In a second type of comma printing mechanism, a decimal point is moved for each set of three digit positions, and fixed comma positions are maintained. Thus, the prior art comma printing mechanisms lack flexibility, as they are not capable of placing a comma in any desired position.

SUMMARY OF THE INVENTION

This invention obviates the aforementioned disadvantages of the prior art. Accordingly, an object of the invention is to provide a comma printing mechanism which permits commas to be placed at desired locations in a printed number to facilitate the reading of the digit positions of the number.

The present invention provides a plurality of comma hammers, each interposed between two adjacent type wheels. The comma hammers move between a printing position and a nonprinting position, and means for normally maintaining the comma hammers in their nonprinting positions and selectively bringing the desired comma hammer or hammers to a printing position are provided.

Additionally, the comma printing mechanism according to the invention is provided with means for releasing all the comma hammers from the nonprinting position, maintaining the released comma hammers in an intermediate position, and releasing only selected comma hammers from the intermediate position to move the selected hammers to a printing position.

Other and additional objects and features of the invention will become evident from the following description.

DETAILED DESCRIPTION

Figure 1:
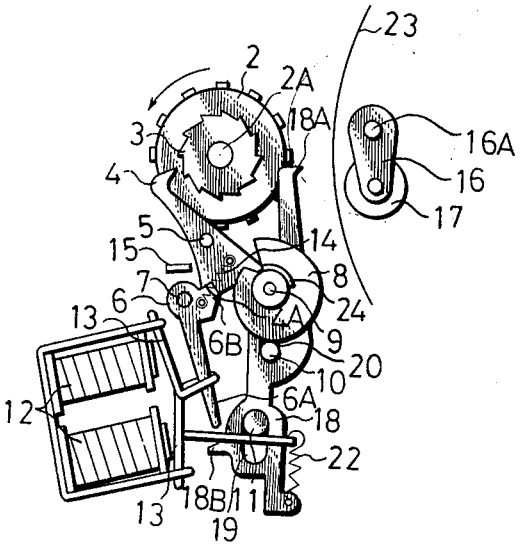
FIG. 1 is an elevational view of a portion of a printer provided with a comma printing mechanism according to the invention.
Figure 2:
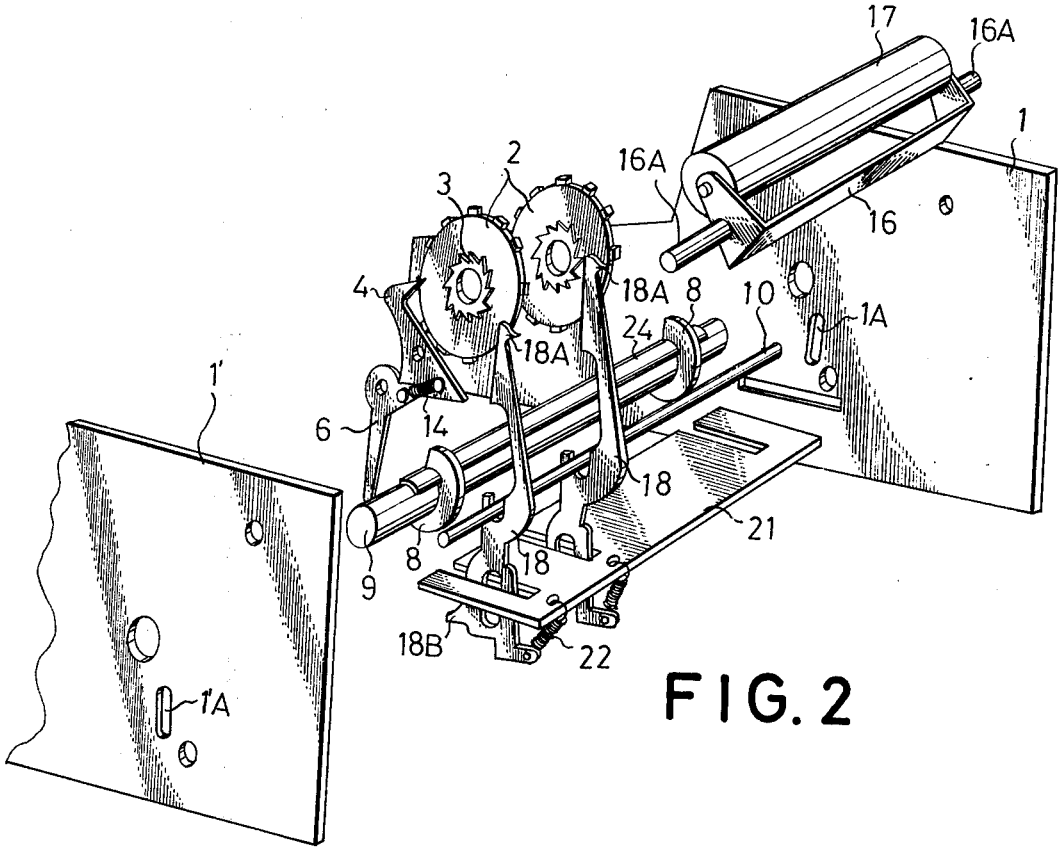
FIG. 2 is a perspective view of a printer incorporating the comma printing mechanism shown in FIG. 1, with certain parts being omitted in the interest of clarity.

The structure of the disclosed comma printing mechanism, and the relevant portions of a printing apparatus into which it is incorporated, are shown in FIG. 1 and FIG. 2. A shaft 2A for type wheels 2, a shaft 5 for mounting thereon selectors 4 each adapted to be brought into and out of engagement with a ratchet wheel 3 attached to one of the type wheels 2, a shaft 7 for mounting thereon trigger claws 6, a main shaft 9 to which two comma cams 8 and a resetter 24 are affixed, a hammer reset shaft 10, and a hammer shaft 11 are connected at opposite ends thereof to two side plates 1 and 1'. An electromagnet 12 and an actuator 13 adapted to engage an arm 6A of the trigger claw 6 are provided for each trigger claw 6. The type wheels 2, selectors 4, trigger claws 6 and actuators 13 are arranged in groups, as in the prior art, and one such group is provided for each digit to be printed.

Each ratchet wheel 3 is affixed to one of the type wheels 2 which are maintained in frictional engagement with shaft 2A. Each type wheel 2 normally rotates in the direction of the arrow shown in FIG. 1 in slaved relation to shaft 2A. However, if a hooked front end of the selector 4 is brought into engagement with the associated ratchet wheel 3, the rotation of the type wheel 2 is interrupted and the latter stops in spite of the fact that shaft 2A continues to rotate. A tension spring 14 is mounted between each selector 4 and the associated trigger claw 6 to urge the associated selector 4 by its biasing force to move about shaft 5 in a clockwise direction so that the hooked front end of the selector 4 is brought into engagement with the associated ratchet wheel 3. However, since the trigger claw 6 is normally maintained, at a claw end 6B thereof, in engagement with the associated selector 4 at a cutout 4A thereof, as shown in FIG. 1, engagement of the hooked front end of the selector 4 with the ratchet wheel 3 is precluded. A stopper 15 is provided for each selector 4.

A shaft 16A for a platen holder 16 is rotatably supported at opposite ends thereof by the side plates 1 and 1', with a platen 17 being rotatably supported by the platen holder 16.

Comma hammers 18 are provided, each formed therein with a slot 19 through which the hammer shaft 11 extends. Each comma hammer 18 is formed therein with a recess 20 in which the hammer reset shaft 10 is fitted. The hammer reset shaft 10 is movably received at opposite ends thereof in slots 1A and 1'A formed in the side plates 1 and 1', respectively, and interposed between the bottom of the recess 20 of each comma hammer 18 and the outer periphery of each comma cam 8. Each comma hammer 18 is formed with a comma printing portion 18A and a projection 18B adapted to be brought into engagement with the arm end 6A of the associated trigger claw 6. A tension spring 22 is mounted between a support plate 21 mounted on the side plates 1 and 1' and the lower edge of each comma hammer 18 to urge the associated comma hammer 18 by its biasing force to move into a printing position.

The disclosed comma printing mechanism operates as follows. When the printer is in its initial position, as shown in FIG. 1, each type wheel 2 rotates in the direction of the arrow, and the associated selector 4 has its cutout 4A maintained in engagement with the claw end 6B of the trigger claw 6, so that the hooked front end of the selector 4 is out of engagement with the associated ratchet wheel 3. The hammer reset shaft 10 is moved downwardly to a lower position as it engages a crest of each comma cam 8. This causes each comma hammer 18 to move to a lower position against the biasing force of the associated spring 22, so that the comma printing portion 18A of each comma hammer 18 is out of a comma printing position.

Figure 3:
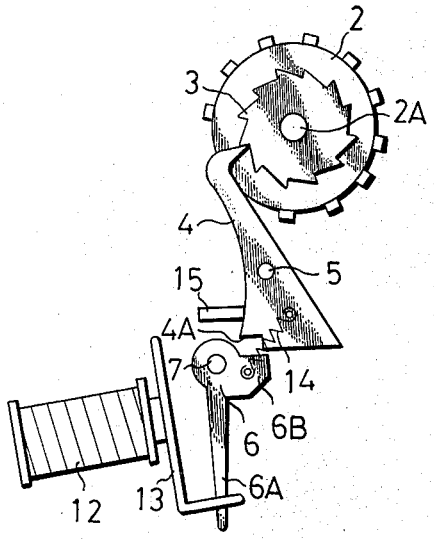
FIG. 3 is a partial elevational view of the printer portion shown in FIG. 1.

While the components of the printer are in the indicated positions, for each digit to be printed on electric current is applied to the electromagnet 12 at a suitable timing corresponding to the desired digit position to render its actuators 13 operative. Upon being rendered operative, the actuator 13 applies force to arm 6A, causing the associated trigger claw 6 to move clockwise about shaft 7, as shown in FIG. 3. This causes the claw end 6B of the trigger claw 6 to be released from engagement with the cutout 4A of the associated trigger claw 6 and permits the selector 4 to move clockwise about shaft 5 in response to the biasing force of the associated tension spring 14, so that the hooked end of the selector 4 is brought into engagement with the associated ratchet wheel 3. Thus, the rotation of the ratchet wheel 3 and the type wheel 2 to which the ratchet wheel 3 is secured is interrupted.

Figure 4:
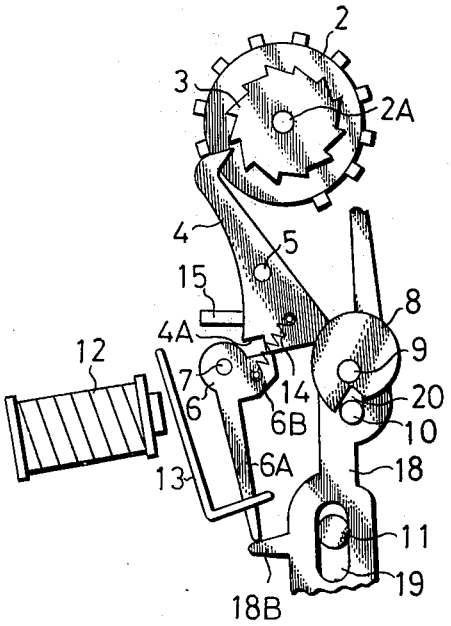
FIG. 4 is similar to FIG. 3 but shows a different step in the operational sequence of the mechanism.

When the supply of current to the electromagnet 12 is cut off, the actuator 13 is restored to its original position, as shown in FIG. 4, and the claw end 6B of the trigger claw 6 is brought into engagement with a side edge of the selector 4 adjacent its cutout 4A.

In this way, all the type wheels 2 corresponding to the positions of the digits to be printed are rendered stationary at their respective selected positions. Upon completion of this operation, a valley of each comma cam 8 rotates into alignment with the hammer reset shaft 10 which rides on the comma cam 8, so that the shaft 10 and the comma hammers 18 are moved upwardly by the biasing force of the springs 22. The upward movement of the comma hammers 18 is interrupted when each comma hammer 18 reaches an intermediate position in which the projection 18B of the comma hammer 18 is brought into abutting engagement with the arm end 6A of the associated trigger claw, as shown in FIG. 4.

Figure 5:
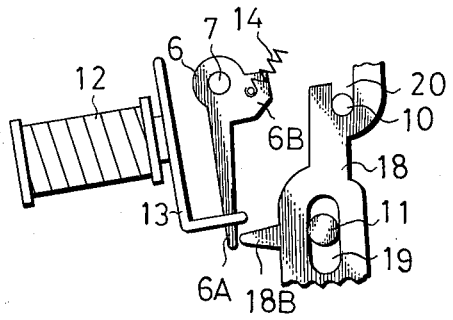
FIG. 5 is similar to FIG. 4 and shows another step in the operational sequence of the mechanism.
Figure 6:
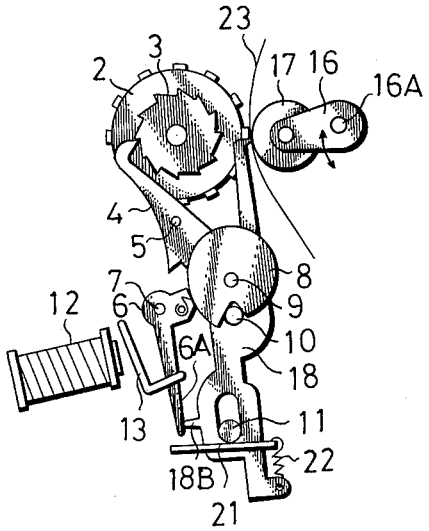
FIG. 6 is similar to FIG. 5 and shows still another step in the operational sequence of the mechanism.

Subsequently, an electric current is again passed through those electromagnets 12 situated in positions in which comma printing is desired and their corresponding actuators 13 are again rendered operative. Thus, the arm end 6A of the associated trigger claw 6 is brought out of engagement with the projection 18B of the associated comma hammer 18, as shown in FIG. 5. This permits the comma hammer 18 to be moved further upwardly by the biasing force of the associated spring 22, the upward movement of the comma hammer 18 being interrupted when the comma printing portion 18A thereof reaches its comma printing position, as shown in FIG. 6. Then, while the type wheels 2 and the comma hammers 18 remain stationary, the platen 17, which is supported by the platen holder 16 which synchronously rotates with the main shaft 9, rotates into a position in which it presses a printing sheet 23 into engagement with the type wheels 2 and the comma printing portions 18A of the selected comma hammers 18, thereby enabling a printing operation to be performed.

Figure 7:
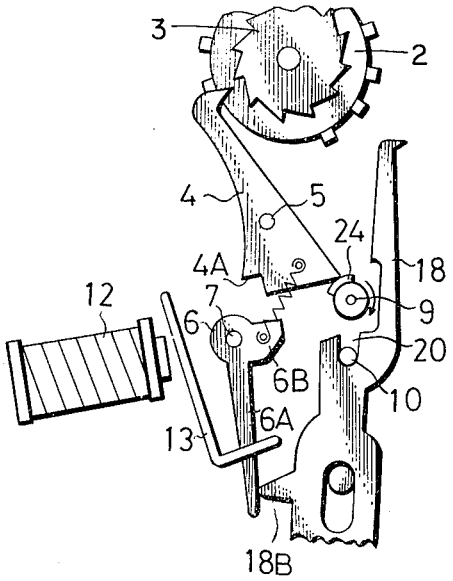
FIG. 7 is a view similar to FIG. 6 and shows still another step in the operational sequence of the mechanism.

Resetting is effected after completion of the printing operation as follows. The resetter 24 affixed to the main shaft 9 causes the associated selector to move counterclockwise about shaft 5 as shown in FIG. 7, so that the selector 4 is brought out of engagement with the associated ratchet wheel 3, and the claw end 6B of the associated trigger claw 6 is brought out of engagement with the side edge of the selector 4. This permits the trigger claw 6 to be moved counterclockwise by the biasing force of the spring 14 until the arm 6A thereof abuts against the projection 18B of the associated comma hammer 18. Then, the comma hammer 18 is moved downwardly by hammer reset shaft 10 which is in turn driven by the comma cam 8 affixed to the main shaft 9. This releases the arm 6A of the trigger claw 6 from engagement with the projection 18B of the comma hammer 18, so that the trigger claw 6 is further moved counterclockwise by the biasing force of the spring 14 until the claw end 6B is brought into engagement with the cutout 4A in the selector 4. This restores all the components of the printer to their initial positions as shown in FIG. 1.

Figure 8:
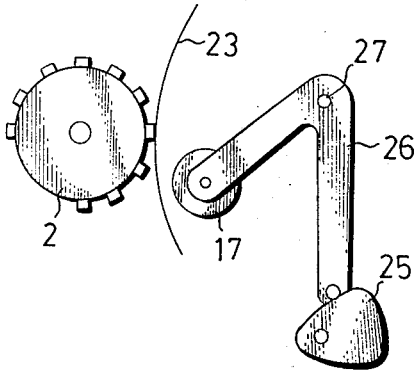
FIG. 8 is an elevational view showing an alternate embodiment of a platen mechanism.
Figure 9:
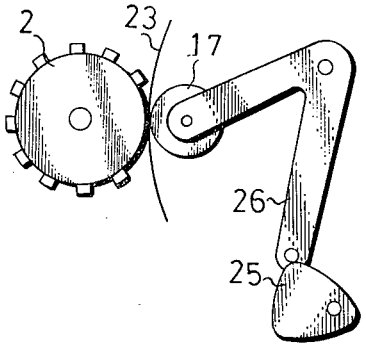
FIG. 9 is similar to FIG. 8 and shows another step in the operational sequence of the platen mechanism.

Referring to the alternate platen embodiment of FIG. 8, a cam 25 synchronously rotating with the main shaft 9 causes a platen lever 26 to pivot about a fulcrum 27 so as to cause the platen 17 to perform a printing action. As the platen 17 is restored to its original position after performing the printing action, a clearance is provided between the returning platen 17 and the outer periphery of the type wheel 2 because the platen is juxtaposed against a portion of the outer periphery of the type wheel 2 on which no type is superposed, as shown in FIG. 9.

Figure 10:
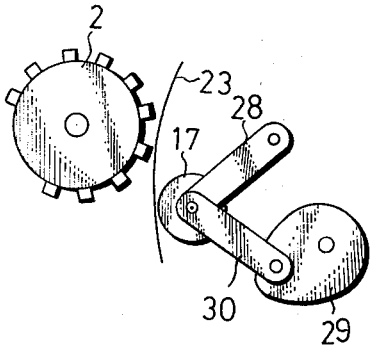
FIG. 10 is a view similar to FIG. 9 and showing still another alternate embodiment of the platen mechanism.

In the alternate embodiment of FIG. 10, a platen lever 28 is moved in pivotal motion by means of an eccentric cam 29 and a link 30. As the platen 17 is restored to its original position, it is also necessary to bring the outer periphery of the type wheel and the platne into the same relation as described with reference to FIG. 9.

From the foregoing description, it will be appreciated that the present invention enables a decimal point or a comma, such as for indicating the beginning or the end of a set of three digit positions, to be placed in any desired position. It will be understood that in most cases there is no need for a comma hammer between the type wheels for the three lowest digit positions because usually no comma will be placed between these digit positions, even if the comma floats. Additionally, no excessive load is applied to the printing members in the instant invention, because the trigger claws are not brought into contact with the comma printing mechanism while the type faces are bring selected.

I claim:

1. A printing apparatus comprising:

a row of rotatable type wheels, each type wheel having a plurality of printing characters around its periphery;

a selector for each type wheel and means for biasing each selector to move from a reset position in which it does not engage its type wheel and interfere with rotation thereof toward an operative position in which it engages its type wheel to prevent rotation thereof and align a selected printing character thereof with a printing position, each selector moveable from the operative to the reset positions against the force of said biasing means;

a trigger claw for each selector and means for biasing each trigger claw to move from an energized position toward a reset position in which it engages its selector, provided the selector is in its reset position, to prevent the selector from moving to its operative position, said trigger claw being movable against the force of its biasing means from the reset position to an energized position in which it does not so engage its selector and allows its selector to move from its reset position to its operative position under the force of its biasing means;

an electromagnet for each trigger claw, each electromagnet being momentarily energizable to momentarily move its trigger claw from the reset to the energized position thereof and to thus disengage the moved trigger claw from the selector engaged thereby to allow the selector to move from its reset to its operative position under the force of the biasing means thereof;

a comma hammer for each of a selected plurality of adjacent type wheels, each comma hammer having a comma printing end, and means for biasing each comma printing end to move from a reset position in which it is out of alignment with said printing position of the characters toward a printing position at which its printing end is aligned with the printing position for said characters, each comma hammer engaging the trigger claw of its type wheel, provided the last recited trigger claw is in its reset position, in moving from the reset toward the printing position and being held thereby at a typing position intermediate said reset and said printing position thereof; and means for resetting each selector and comma hammer prior to a printing operation, means for momentarily energizing selected electromagnets to momentarily move the trigger claws thereof from the reset to the energized positions thereof and then allow the trigger claws to return to their reset positions after the electromagnets are deenergized, said movement of the trigger claws allowing the selectors thereof to move from their reset to their operative positions and align selected characters of the type wheels thereof with the printing position, means responsive to the movement of a trigger claw from the energized to the reset position thereof to allow the comma hammer thereof to move from its reset toward its typing position, and means for momentarily energizing selected electromagnets for a second time to again momentarily move their trigger claws from the reset to the energized positions and out of engagement with the comma hammers thereof, to thereby allow the comma hammers thereof to move from the typing to the printing positions under the action of the biasing means of the comma hammers, whereby upon a first momentary energization of selected electromagnets, the trigger claws engaged thereby release the associated selectors from their reset to their operative positions to hereby align selected characters with said printing position, each comma hammer is subsequently released form its reset position upon the return of the associated trigger claw to its reset position and moves to its intermediate, typing position, and each comma hammer moves to its printing position only if the electromagnet of the trigger claw engaging it is momentarily energized a second time.

2. A printing apparatus as in claim 1 wherein the means for resetting each selector and comma hammer prior to a printing operation and for allowing the comma hammer to move to its reset position in response to the return of the associated trigger claw to its reset position after releasing the associated selector comprises:

a rotatable main shaft;

a resetter bar affixed to said rotatable main shaft and engaging each selector upon rotation of said main shaft to a defined angular position thereof to place each selector in its reset position;

a comma cam affixed to said rotatable main shaft and having a crest and a valley, said crest and valley being in a defined angular position with respect to the resetter bar;

a recess on said comma hammer;

a hammer shaft positioned in said recess and engaging said comma cam and the comma hammers to reset said comma hammer when said comma cam crest is in a selected rotational alignment with said hammer shaft, and said resetter bar resetting said selectors when said resetter bar is in a selected rotational alignment with said selectors, said crest maintaining said comma hammer in its reset position until the associated trigger claw has returned to its reset position after releasing the associated selector and said comma hammer then being released from said reset position upon alignment of said comma hammer valley with said hammer reset shaft upon further rotation of the main shaft.

3. A printing apparatus having a plurality of rotatable type wheels each with a plurality of printing characters around its periphery, a selector for each type wheel, each selector biased from a reset position in which it does not engage its type wheel toward an operative position in which it engages its type wheel to stop the type wheel with a selected printing character thereof in a printing position, a trigger claw for each selector, each trigger claw biased from an energized position toward a reset position and each engaging its selector, when the selector has been moved to its reset position and the trigger claw is in its reset position, to prevent the selector from moving to its operative position, an actuator for each trigger claw, each actuator being momentarily energizable to momentarily move its trigger claw to the energized position and to thus release the selector engaged thereby to allow the selector to move to its operative position, and a platen adapted to move relative to the type wheels to print the characters in the printing position, wherein the improvement comprises a comma printing mechanism having:

a comma hammer for each of a selected plurality of adjacent type wheels, each comma hammer having a comma printing end;

means for biasing each comma hammer to move from a reset position toward a printing position at which its printing end is aligned with the printing position for said characters, said comma hammer engaging the reset trigger claw of the associated type wheel in moving from the reset toward the printing position to thereby stop at a position intermediate said reset and said printing positions thereof;

means for resetting each selector and comma hammer prior to a printing operation and for maintaining the comma hammer in its reset position until its trigger claw has returned to its reset position after releasing its selector;

means for momentarily energizing selected actuators for a first time to cause their trigger claws to release their selectors and allow them to move from their reset to their operative positions, to thereby place selected characters in their printing positions, each comma hammer being released from its reset position upon the return of the associated trigger claw to its reset position to move to its intermediate position; and means for momentarily energizing at least one actuator for a second time to thereby cause its comma hammer to move from its intermediate position to its printing position.

4. A printing apparatus as in claim 3 wherein the means for resetting each selector and comma hammer prior to a printing operation and for maintaining the comma hammer in its reset position until the associated trigger claw has returned to its reset position after releasing the associated selector comprises:

a rotatable shaft;

a resetter bar affixed to said rotatable main shaft, said bar movable upon rotation of the main shaft from a position out of engagement with the selector into a position in which the bar engages each selector to place it in its reset position;

a comma cam affixed to said rotatable main shaft and having a crest and a valley which are in a defined circumferential alignment with said bar;

a recess on each comma hammer;

a hammer shaft positioned in said recess and engaging said comma cam, said hammer shaft resetting each comma hammer when the comma cam crest is in rotational alignment with said hammer shaft, and maintaining each comma hammer in the reset position until the associated trigger claw has returned to its reset position after releasing the associated selector, said comma hammer then being released from said reset position upon the rotation of said comma hammer valley into alignment with said hammer reset shaft.

* * * * *